US010526832B2

(12) United States Patent
Gruca et al.

(10) Patent No.: US 10,526,832 B2
(45) Date of Patent: Jan. 7, 2020

(54) WINDOW REGULATOR ASSEMBLY FOR A MOTOR VEHICLE

(71) Applicant: BROSE FAHRZEUGTEILE GMBH & CO. KOMMANDITGESELLSCHAFT, BAMBERG, Bamberg (DE)

(72) Inventors: Jan-Wolfgang Gruca, Hirschaid (DE); Matthias Heppner, Burgkunstadt (DE)

(73) Assignee: BROSE FAHRZEUGTEILE GMBH & CO. KOMMANDITGESELLSCHAFT, BAMBERG, Bamberg (DE)

( * ) Notice: Subject to any disclaimer, the term of this patent is extended or adjusted under 35 U.S.C. 154(b) by 0 days.

(21) Appl. No.: 15/580,178

(22) PCT Filed: Aug. 23, 2016

(86) PCT No.: PCT/EP2016/069846
§ 371 (c)(1),
(2) Date: Jan. 18, 2018

(87) PCT Pub. No.: WO2017/036845
PCT Pub. Date: Mar. 9, 2017

(65) Prior Publication Data

US 2018/0163455 A1 Jun. 14, 2018

(30) Foreign Application Priority Data

Aug. 28, 2015 (DE) ..... 10 2015 216 557

(51) Int. Cl.
*E05F 11/48* (2006.01)
*E05F 15/689* (2015.01)
*E05D 15/16* (2006.01)

(52) U.S. Cl.
CPC ..... *E05F 15/689* (2015.01); *E05D 15/165* (2013.01); *E05Y 2201/654* (2013.01);
(Continued)

(58) Field of Classification Search
CPC ..... E05F 11/483; E05F 11/485; E05F 15/689; E05F 11/488; E05F 11/481; E05D 15/165;
(Continued)

(56) References Cited

U.S. PATENT DOCUMENTS 4,691,475 A * 9/1987 Maekawa ..... B60J 1/17 49/349
5,469,662 A * 11/1995 Tenbrink ..... B60J 5/0413 49/349
(Continued)

FOREIGN PATENT DOCUMENTS

CN 101616817 A 12/2009
CN 101730780 A 6/2010
(Continued)

OTHER PUBLICATIONS

Second Chinese Examination Report dated Sep. 26, 2019 issued in corresponding CN Application No. 201680046588.1, 7 pages; with English translation, 3 pages.

*Primary Examiner* — Chi Q Nguyen
(74) *Attorney, Agent, or Firm* — Lewis Roca Rothgerber Christie LLP

(57) ABSTRACT

It is provided a window regulator assembly of a motor vehicle, comprising: a carrier; a guiding device provided on the carrier for guiding a flexible traction means via which an adjusting force produced on an adjustment drive can be transmitted to a window pane to be adjusted; a flexible traction means guided on the guiding device on which at least one driver is fixed, via which the window pane to be
(Continued)

adjusted can be connected with the flexible traction means, so that when a force is introduced into the flexible traction means, the driver together with a window pane attached thereto is adjusted by an adjustment drive along a longitudinally extended adjustment path defining an adjustment surface a socket for bearing a deflection element by means of which the flexible traction means can be deflected; and a deflection element pivotally mounted on the socket.

16 Claims, 8 Drawing Sheets

(52) U.S. Cl.
CPC ..... *E05Y 2201/66* (2013.01); *E05Y 2600/11* (2013.01); *E05Y 2600/46* (2013.01); *E05Y 2900/55* (2013.01)

(58) Field of Classification Search
CPC ..... E05D 15/18; E05Y 2600/528; E05Y 2600/626; E05Y 2900/55; E05Y 2600/46; E05Y 2600/56; B60J 5/0413
USPC ..... 49/352, 348, 349, 350, 372, 227, 502, 49/501
See application file for complete search history.

(56) References Cited

U.S. PATENT DOCUMENTS

| | | | | |
|---|---|---|---|---|
| 5,513,468 | A * | 5/1996 | Diestelmeier | E05F 11/385 49/351 |
| 6,170,197 | B1 * | 1/2001 | Tyves | E05F 11/385 49/358 |
| 6,502,352 | B1 * | 1/2003 | Bonduel | E05F 11/445 49/26 |
| 8,061,083 | B2 * | 11/2011 | Shirai | E05F 15/697 49/349 |
| 8,418,405 | B2 * | 4/2013 | Yoshida | E05F 11/445 49/348 |
| 8,650,800 | B2 * | 2/2014 | Anderson | E05F 11/445 49/351 |
| 8,707,623 | B2 * | 4/2014 | Mori | E05F 11/445 49/348 |
| 9,970,226 | B2 * | 5/2018 | Stewart | E05F 11/385 |
| 2004/0216382 | A1 * | 11/2004 | Jaerpsten | E05F 11/445 49/351 |
| 2008/0222962 | A1 | 9/2008 | Staser et al. | |
| 2010/0031575 | A1 | 2/2010 | Kinoshita et al. | |
| 2011/0010999 | A1 | 1/2011 | Broadhead et al. | |
| 2015/0275560 | A1 * | 10/2015 | Yamamoto | E05F 11/488 49/352 |
| 2015/0322706 | A1 * | 11/2015 | Yamamoto | E05F 11/488 49/349 |

FOREIGN PATENT DOCUMENTS

| | | | |
|---|---|---|---|
| CN | 101801698 | A | 8/2010 |
| DE | 102005041636 | A1 | 3/2007 |
| DE | 102006042136 | A1 | 3/2007 |
| DE | 202006018071 | U1 | 5/2008 |
| EP | 1 243 733 | A1 | 9/2002 |
| JP | 2007218045 | A | 8/2007 |
| WO | WO 2008/061906 | A2 | 5/2008 |

* cited by examiner

WINDOW REGULATOR ASSEMBLY FOR A MOTOR VEHICLE

CROSS-REFERENCE TO A RELATED APPLICATION

This application is a National Phase patent application of International Patent Application Number PCT/EP2016/069846, filed on Aug. 23, 2016, which claims priority of German Patent Application Number 10 2015 216 557.4, filed on Aug. 28, 2015, the contents of all of which are incorporated herein by reference.

BACKGROUND

The invention relates to a window regulator assembly of a motor vehicle.

Such motor vehicle window regulator assembly comprises a carrier and a guiding device arranged on the carrier for guiding a flexible traction means, for example in the form of a cable, via which an adjusting moment produced on a window regulator drive (adjustment drive) or an adjusting force connected therewith can be transmitted to a window pane to be adjusted. The guiding device for example can be formed by deflection means and one or more guide rail(s) by means of which the flexible traction means is guided in an adjustment portion along the adjustment direction of the window pane to be adjusted. The carrier on which the guiding device is accommodated can be a module carrier which together with functional components premounted thereon, such as the components of a window regulator assembly, is incorporated into a motor vehicle door.

To the flexible traction means of the window regulator assembly guided by means of the guiding device at least one driver is fixed, via which the window pane to be adjusted is connected with the flexible traction means. The driver is disposed e.g. on an adjustment portion of the flexible traction means, which extends along a guide rail extending in an adjustment direction, and longitudinally movably engages into the guide rail, whereby the driver (and hence also the adjustment portion of the flexible traction means and the window pane to be adjusted) is guided along the guide rail. When a force is introduced into the flexible traction means (by an associated adjustment drive), the window pane thereby is adjusted by the driver along a longitudinally extended flat adjustment path which is defined by the guidance of the driver and the flexible traction means by means of the guiding device.

When shifted along the adjustment path, the driver and the window pane to be adjusted move on an adjustment surface which thus is specified (defined) by the adjustment path.

To be able to guide the flexible traction means, which proceeds from the adjustment drive, in a targeted way along one or more guide rails of the guiding device, deflection means are provided. In the present case, at least one deflection element is mounted on a socket of the window regulator assembly such that by a swivel movement the deflection element can be transferred from a mounting position into its proper functional position on the socket, with the flexible traction means being tightened at the same time. In its functional position the deflection element then is kept stationary, so that it does not return into the mounting position.

Such a device is known from EP 1 243 733, wherein the pivot axis of the deflection element extends vertically to the adjustment plane of the window pane to be adjusted, i.e. vertically to a plane along which the window pane moves during an adjustment operation in an adjustment direction.

In the known arrangement, the cable forces acting on the deflection element have the tendency to bring the deflection element out of its functional position into the mounting position. The known solution therefore is suitable for the series production only to a limited extent.

SUMMARY

It is a problem underlying the invention to improve a motor vehicle window regulator assembly as mentioned above with regard to the mountability.

According to the invention, this problem is solved by creating a motor vehicle window regulator assembly with features as described herein.

Accordingly, the deflection element is pivotally mounted on the socket about a physical (i.e. not only virtual) axis which extends along the adjustment surface defined by the adjustment path (i.e. substantially parallel thereto) and at the same time extends transversely to the direction of longitudinal extension of the adjustment path. Based on the condition of the motor vehicle window regulator assembly properly mounted in a motor vehicle door or in a motor vehicle, that axis—at least in the case of a side door—typically extends along the longitudinal vehicle axis (x-axis).

The solution according to the invention provides for a simplified assembly of the window regulator assembly with the flexible traction means being tightened at the same time, as will become clear from the following description of the exemplary embodiments.

The adjustment surface of a window pane to be adjusted, which is defined by the adjustment path of the driver (along which the window pane properly moves during an adjustment operation), in general is not flat, but extends in a curved manner—depending on the configuration of the door body in which the window pane is adjusted. The pivot axis of the deflection element mounted on the socket therefore in general does not extend exactly parallel to the adjustment surface of the window pane, but substantially along that adjustment surface (and at the same time transversely to the direction of longitudinal extension of the adjustment path).

The socket serving for pivotally mounting the deflection element can be arranged on the carrier of the window regulator assembly in a simple way, i.e. be integrally molded thereto or be attached as a separate component. The same applies for guide rails of the guiding device by means of which the flexible traction means is guided along the adjustment direction of the window pane to be adjusted. The carrier in particular can be designed as a plastic carrier. In principle, the socket bearing the deflection element can however also be attached to another component of a motor vehicle door independent of the carrier.

On the socket, locking means, in particular in the form of at least one latching element, furthermore are provided, via which the deflection element can be arrested in its functional position and in which the deflection element engages, in particular snaps into place when it is transferred from its mounting position into its functional position.

According to one development of the invention there are provided multistage locking means which define at least two different locking positions of which the one serves for locking the deflection element in a mounting position and the other one serves for finally locking the deflection element in its proper functional position (after the deflection element has been transferred from the mounting position into the functional position by tightening the flexible traction means).

The deflection element can have the shape of a ring segment which for example extends over an angle of 180°. At the two free ends of the ring segment bearing elements, in particular in the form of bearing pins, can be formed for pivotally mounting the deflection element on the socket.

To reliably avoid a wrong assembly, the deflection element furthermore can be designed symmetrical with respect to a plane in which a cable groove of the deflection element extends for guiding the flexible traction means.

The deflection element furthermore can include at least one actuating surface on which an actuating element can act such that the deflection element is transferred from its mounting position into the functional position. The respective actuating surface in particular can extend parallel to the plane in which the flexible traction means which is deflected by means of the deflection element or the associated cable groove of the deflection element extends. In a deflection element in the form of a ring portion at least two opposite actuating surfaces can be provided.

A respective actuating element acting on an associated actuating surface of the deflection element according to one embodiment can be arranged or formed on the driver fixed on the flexible traction means, so that by moving that driver along the guiding device (by means of an adjusting force applied on the flexible traction means) an actuation of the deflection element can be effected for the transfer from the mounting position into the functional position. Alternatively, a separate mounting carriage can be provided for this purpose, which is shiftably mounted on the guiding device and which includes an actuating element which during a displacement of the mounting carriage along the guiding device acts on an associated mounting surface of the deflection element in order to transfer the same from its mounting position into the functional position.

In a further modification, a mounting lever can be pivotally mounted on the carrier of the window regulator assembly or on the socket bearing the deflection element, which on pivoting by means of an actuating element acts on an associated actuating surface of the deflection element in order to transfer the same from the mounting position into the functional position.

Both the mounting carriage and the mounting lever each are temporarily arranged on the guiding device or on the socket for assembly purposes only and are removed again after termination of the assembly.

The socket provided for pivotally accommodating the deflection element includes bearing regions, in particular in the form of bearing openings, with which the bearing elements of the deflection element can be brought in engagement such that the deflection element is pivotally mounted on the socket so as to be transferred from a mounting position into its functional position by pivoting. In addition, the socket can include a mounting surface, for example in the form of a conical or spherical-section-shaped assembly supporting surface on which the deflection element can be guided when it is transferred from a mounting position into the functional position.

In a window regulator assembly which usually serves for adjusting a window pane along the vertical vehicle axis, i.e. by lifting or lowering the window pane, the deflection element can be provided for deflecting the flexible traction means at a lower end portion of the window regulator assembly, while at the opposite, upper end portion a rotatable cable pulley is used for deflecting the flexible traction means. The final tension of the flexible traction means advantageously is brought about when threading the flexible traction means onto this pulley, in particular by using a self-threading cable pulley.

The (two) portions of the flexible traction means proceeding from the deflection element advantageously extend such that on the flexible traction means a force component acts transversely to the direction of extension of the flexible traction means or transversely to the plane defined by the cable groove of the deflection element, which has the tendency to hold the deflection element in its functional position.

BRIEF DESCRIPTION OF THE DRAWINGS

Further details and advantages of the invention will become apparent from the following description of exemplary embodiments with reference to the Figures.

DETAILED DESCRIPTION

Figures 1, 1A:
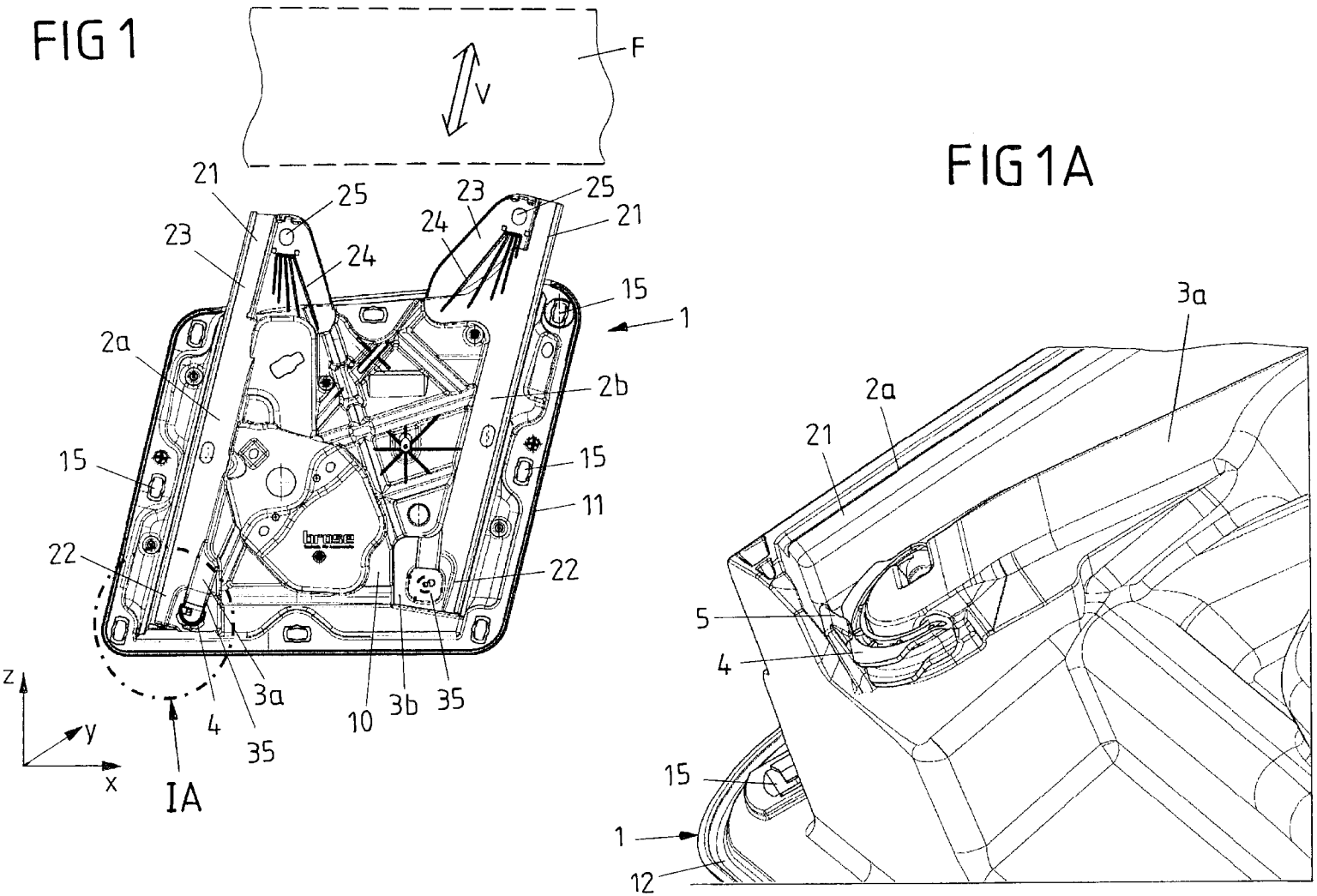
FIG. 1 shows a window regulator assembly arranged on a carrier for adjusting a window regulator of a motor vehicle.
FIG. 1A shows a section of the window regulator assembly of FIG. 1.

FIG. 1 shows a window regulator assembly for a motor vehicle for adjusting, in particular lifting and lowering, a window pane of the motor vehicle. The window regulator assembly is arranged on a carrier 1 which for example can be a so-called module carrier. Such module carrier is equipped with components of the motor vehicle and subsequently, together with the components premounted thereon, incorporated into the motor vehicle, for example into a motor vehicle door. In the case of the installation in a motor vehicle door, the carrier 1 typically covers a large-surface section in the door inner skin and thereby forms a part of the door inner skin, wherein it at the same time contributes to the so-called wet/dry space separation of the vehicle door. Alternatively, the carrier however can also be a direct part of the door inner skin, which only after the installation in the motor vehicle door is equipped with functional components.

The functional components mounted on the carrier 1 in the present case include elements of a window regulator assembly, among them in particular a guiding device for guiding a window pane to be adjusted along an adjustment path V. During an adjusting movement, as indicated in FIG. 1, the flat window pane moves along an adjustment surface F on which the adjustment path V defining the adjustment direction is located.

The guiding device comprises two guide rails 2*a*, 2*b* which each extend along the adjustment path V and which are spaced apart from each other transversely to the adjustment path V. In the exemplary embodiment, the two guide rails 2*a*, 2*b* are integrally molded to the carrier 1. The carrier 1 for example can be made of plastic material; and in the exemplary embodiment it includes a receptacle 12 for a seal on its circumferential outer edge 11, cf. FIG. 1A. Furthermore, attachment points 15 are formed on the carrier 1 for attaching the carrier 1 to a motor vehicle door. Instead of guide rails integrally molded to the carrier 1 separate guide rails, for example made of metal, can be provided, which are attached to the carrier 1 as additional components.

The two guide rails 2*a*, 2*b* each extend from an upper end 21 to a lower end 22 along the adjustment path V. The allocation "at the top" and "at the bottom" refers to the location of the ends 21, 22 of a respective guide rail 2*a*, 2*b* when it is properly installed in a motor vehicle with a vertical vehicle axis z, wherein the guide rails 2*a*, 2*b* also are spaced apart from each other along the longitudinal vehicle axis x.

With an upper end portion 23 the two guide rails 2*a*, 2*b* each protrude beyond the upper end of the carrier 1 along the adjustment path V or along the vertical vehicle axis z, whereby a pane lift going beyond the vertical extension of the carrier 1 can be achieved. For stabilizing the guide rail, reinforcing ribs 24 are formed in said end portions 23.

As will yet become clear with reference to the further Figures, the two guide rails 2*a*, 2*b* on the one hand serve to guide one driver each, which carries the window pane to be adjusted. By shifting the drivers along the guide rails 2*a*, 2*b*, the window pane to be adjusted can be moved along the adjustment path V, namely be lifted or lowered—relative to the vertical vehicle axis z. Furthermore, the guide rails 2*a*, 2*b* (indirectly, mediated by a respective driver) serve to guide a flexible traction means, for example in the form of a cable which in the usual way is coupled with an adjustment drive and on which on the other hand a driver for each guide rail respectively is fixed. The movement of a respective driver along the associated guide rail 2*a* and 2*b* accordingly is triggered by an introduction of force into the flexible traction means by means of the associated adjustment drive. The flexible traction means each is guided on the guide rails 2*a*, 2*b* (via a respective driver) substantially along their direction of extension.

For guiding a flexible traction means along the respective guide rail 2*a*, 2*b* deflection means also are associated with the guide rails 2*a*, 2*b*, by means of which the flexible traction means proceeding from the adjustment drive can be deflected such that it can extend on the respective guide rail 2*a*, 2*b* along the direction of extension and thus can move a respective driver along the associated guide rail. At the upper end 21 of a respective guide rail 2*a*, 2*b* one bearing point 25 each is provided here for rotatably mounting a cable pulley. In the region of the lower end 22 of a respective guide rail 2*a*, 2*b* on the other hand there is each formed a bearing point 35 for stationarily mounting a deflection element 4. The respective bearing point 35 does not form a direct part of a guide rail 2*a*, 2*b*; but it rather is formed on a socket 3*a*, 3*b* which beside the respectively associated guide rail 2*a*, 2*b* is arranged on the carrier 1 or more exactly is integrally molded out of the same. Alternatively, a respective socket 3*a*, 3*b* also can be adapted to be arranged on a motor vehicle independent of the carrier 1.

In the present case, one particularity consists in how a respective deflection element 4 on the associated socket 3*a*, 3*b* can be transferred into its functional position in which it serves for properly deflecting the flexible traction means and in which the deflection forces acting on the deflection element can be dissipated into the associated socket 3*a*, 3*b*. This will be discussed in detail below by way of example with reference to the deflection element 4 arranged on the socket 3*a* in the region of the lower end 22 of the first guide rail 2*a*. The explanations alternatively can also be applied to a deflection element at the lower end 22 of the second guide rail 2*b*. Finally, a corresponding deflection element also can be arranged at the upper end 21 of the respective guide rail 2*a*, 2*b*, where according to the exemplary embodiment shown in FIG. 1 one rotatably mounted cable pulley each is to be arranged.

In FIG. 1A the surroundings of the deflection element 4 at the lower end 21 of the first guide rail 2*a* again are shown on an enlarged scale. The following explanations will refer thereto by way of example. FIG. 1A additionally shows a locking element 5 by means of which the deflection element 4 can be locked in its functional position on the socket 3*a*. This, too, will yet be explained in detail below.

Figure 2C:
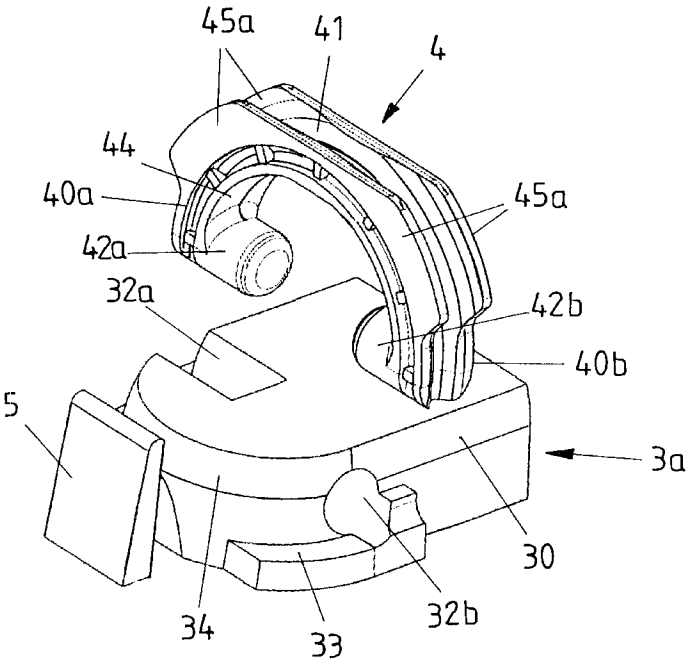
FIG. 2C shows the deflection element of FIG. 2A together with the socket of FIG. 2B when arranging the deflection element on the socket.
Figure 2A:
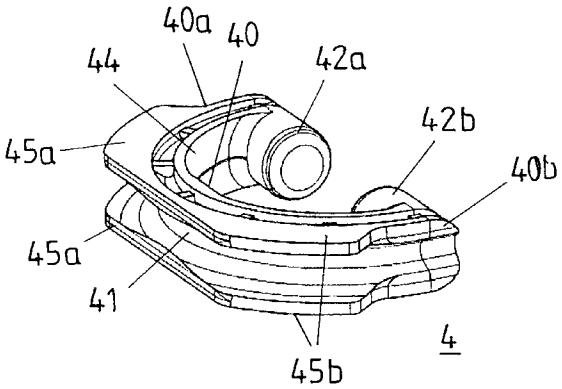
FIG. 2A shows a deflection element of the window regulator assembly of FIG. 1 for deflecting a flexible traction means.

FIG. 2A shows the deflection element 4 of FIGS. 1 and 1A as an individual part. Accordingly, in the exemplary embodiment the deflection element 4 is formed by a ring segment 40 which here extends over an angle of 180°, namely in the exemplary embodiment substantially along a circular path. On the outside of the deflection element 4 a cable groove 41 is provided for guiding and deflecting a flexible traction means; and on the inside a mounting surface 44 is formed, by means of which during the assembly the deflection element 4 can slide over an associated mounting surface 34 on the socket 3*a*, cf. FIG. 2B.

Figure 2B:
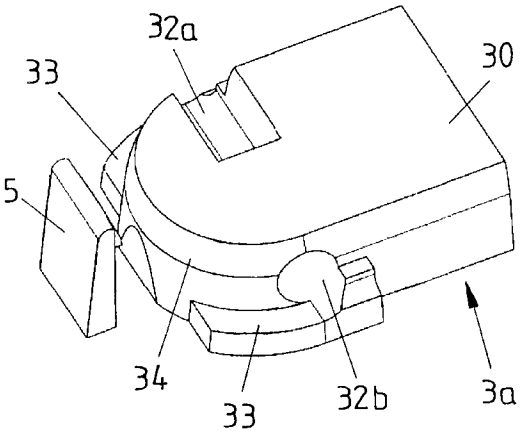
FIG. 2B shows a socket for bearing the deflection element of FIG. 2A.

At the two free ends 40*a*, 40*b* of the deflection element 4 one bearing element 42*a*, 42*b* each, here in the form of a bearing pin, protrudes from the same, namely in the exemplary embodiment to the inside. The deflection element 3 thereby can be mounted on a socket 3*a*, as shown in FIGS. 2B and 2C. Concretely, a pivotal bearing of the deflection element 4 on the socket 3*a* is provided such that on a socket 3*a* the deflection element 4 can be transferred from a mounting position into its proper functional position (end position) on the socket 3*a* by pivoting. For an action of force on the deflection element 4 to bring about said swivel movement, actuating surfaces 45*a*, 45*b*, here in the form of actuating tabs, are formed on the deflection element. In the exemplary embodiment, the same are arranged symmetrically with respect to that plane in which the cable groove 41 and a flexible traction means guided thereon extend. In the present case, the deflection element 4 in general is designed symmetrically with respect to that plane, whereby a wrong installation of the deflection element 4 while being mounted on a socket 3*a* will be excluded. Independent of which one of the two bearing elements 42*a*, 42*b* of the deflection element 4 is inserted into which one of the two bearing points 32*a*, 32*b* of the socket 3*a*, cf. FIG. 2B, the resulting configuration each is the same because of the symmetrical configuration of the deflection element 4, as is also shown with a view to FIG. 2C. In addition, the end portions 40*a*, 40*b* on both sides of the deflection element 4 also are formed mirror-symmetrical to each other.

With reference to FIGS. 2B and 2C it furthermore becomes clear that the two bearing points 32*a*, 32*b* of the socket 3*a*, in each of which one of the bearing elements 42*a*, 42*b* of the deflection element 4 is accommodated, each are designed as a bearing opening. However, the two bearing points 32*a*, 32*b* are designed (geometrically) different. The one bearing point 32*a* is formed by a shaft-shaped receptacle into which the associated bearing element 42*a*, as shown in FIG. 2C, can be introduced in a direction vertical to the resulting pivot axis (i.e. radially with respect to the axis S of FIG. 3C). The other, second bearing point 32*b* on the other hand is formed by a bearing hole, for example in the form of a blind hole, into which the associated bearing element 42*b* is to be introduced along the resulting pivot axis S (i.e. axially). The first-mentioned bearing point 32*a* accordingly forms an open swivel bearing and the second bearing point 32*b* forms a closed swivel bearing.

On the base body 30 of the deflection element 3*a* supports 33 furthermore are arranged or formed, namely adjacent to each of the two bearing points 32*a*, 32*b*, which serve as supports for the bearing elements 42*a*, 42*b* during the assembly of a deflection element 4.

Finally, FIGS. 2B and 2C also show a locking element 5 associated with the socket 3*a*, by means of which the deflection element 3*a* can be locked in its proper functional position on the socket 3*a*, as will be described below with reference to FIGS. 3A to 3C.

Figure 3A:
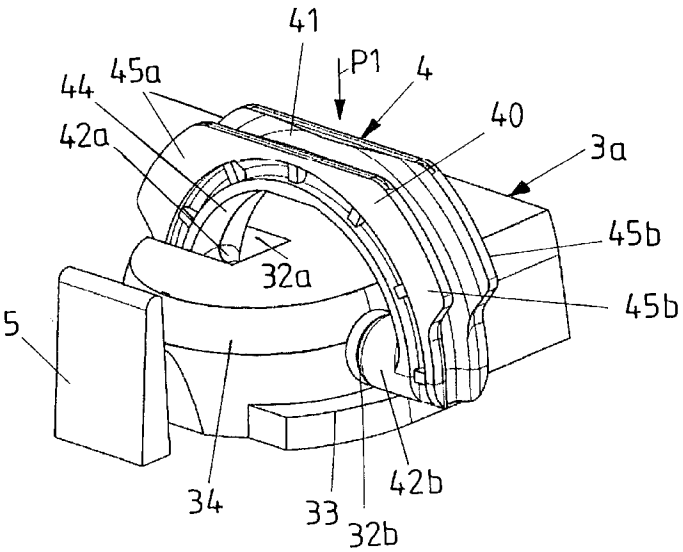
FIG. 3A shows the deflection element of FIG. 2A in a condition in which it is pivotally mounted on the socket of FIG. 2B.

FIG. 3A shows the socket 3*a* and the deflection element 4 in a condition in which the deflection element 4 has been put onto the socket vertically, i.e. radially, with respect to the resulting bearing axis, so that the one bearing element 42*a* of the deflection element 4 has been introduced into the associated bearing point 32*a* in the form of a shaft-shaped bearing opening on the socket 3*a*. The corresponding mounting direction is indicated in FIG. 3*a* by an arrow P1. In this condition, the second bearing element 42*b* of the deflection element 4 still is outside the associated bearing point 32*b* on the socket 3*a*.

Figure 3C:
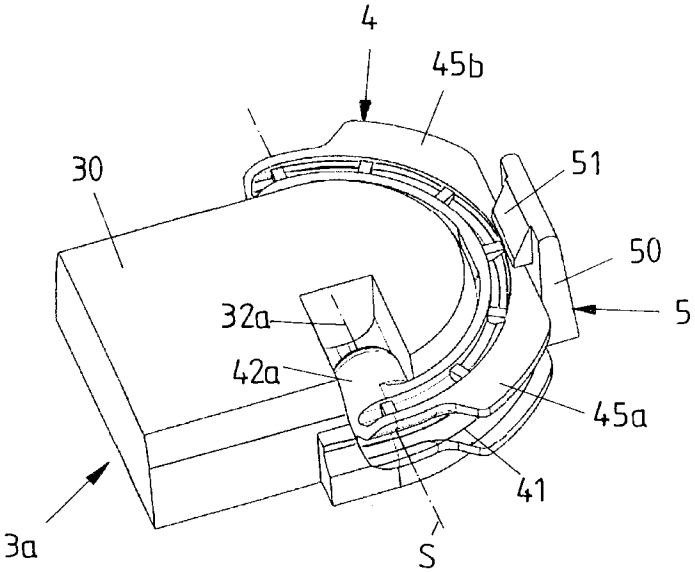
FIG. 3C shows the arrangement of FIGS. 3A and 3B after pivoting the deflection element into its functional position on the socket, wherein the deflection element is locked in its functional position.

In the condition shown in FIG. 3A, in which merely one bearing element 42*a* of the deflection element 4 has already been introduced into the associated socket-side bearing point 32*a*, pivoting of the deflection element 4 in the direction of its proper functional position, as shown in FIG. 3C, is not yet possible. This is counteracted by the side walls of the shaft-like first bearing point 32*a* on the socket 3*a*. It can thus be prevented that the deflection element 3*a* might be transferred into its functional position, without previously having been properly mounted on the socket 3*a* via both bearing elements 32*a*, 32*b*.

Figure 3B:
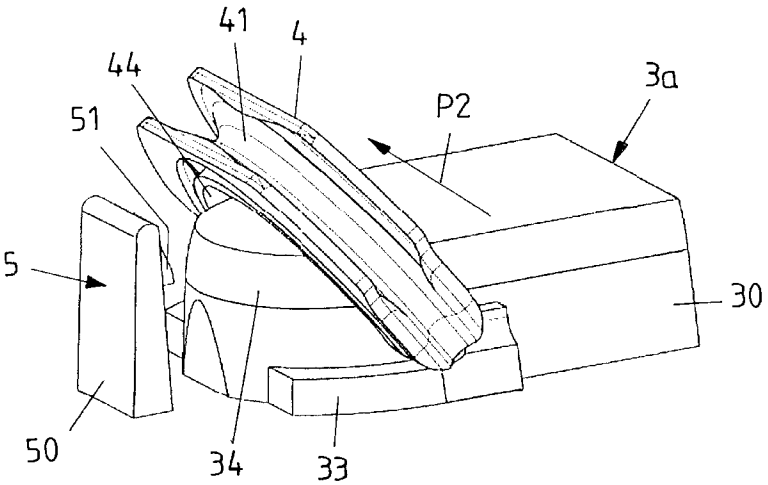
FIG. 3B shows the arrangement of FIG. 3A when pivoting the deflection element from a mounting position into the proper functional position.

For proper bearing, corresponding to the transition from FIG. 3A to FIG. 3B, shifting of the deflection element 4 in axial direction first is necessary, as indicated by the arrow P2 in FIG. 3B, in order to bring its second bearing element 42*b* in engagement with the associated bearing point 32*b* on the socket 3*a*. In the exemplary embodiment this is accomplished in that the second bearing element 42*b* of the deflection element 4 formed as bearing pin is axially inserted into the bearing point 32*b* of the socket 3 formed as bearing hole (blind hole).

The condition of the arrangement shown in FIG. 3B furthermore differs from the one shown in FIG. 3A by the fact that the deflection element 4 according to FIG. 3B already has been pivoted to some extent (about the pivot axis formed by the bearing elements 32*a*, 32*b* and the bearing points 42*a*, 42*b*) in the direction of the proper functional position, cf. FIG. 3C. Said real pivot axis S formed by physical elements 32*a*, 32*b*; 42*a*, 42*b* (bearing points and associated bearing elements) additionally is shown in FIG. 3C in dash-dotted lines. The pivot axis S extends along the adjustment surface F defined by the adjustment path V, cf. FIG. 1, and furthermore transversely to the direction of longitudinal extension of the adjustment path V.

Based on the condition of the window regulator assembly properly mounted in a motor vehicle door or in a motor vehicle, that pivot axis S—at least in the case of a side door—extends along the longitudinal vehicle axis (x-axis).

As a result, FIG. 3B shows the deflection element 4 in a mounting position on the socket 3*a*, in which the deflection element 4 already has been properly mounted on the socket 3*a* (via the bearing elements 32*a*, 32*b* and the bearing points 42*a*, 42*b*), but in which the deflection element 4 not yet is in its functional position (end position) in which it will properly serve for deflecting a flexible traction means of the window regulator assembly. This functional position rather is taken by pivoting the deflection element 4 with respect to the socket 3*a* about the swivel axis S, as becomes clear with reference to the transition from FIG. 3B to FIG. 3C. During this swivel movement, the deflection element 4 at least sectionally slides with its (inner) mounting surface 44 over the associated (e.g. conical or spherical-section-shaped) mounting surface 34 on the socket 3*a*.

In its functional position, as shown in FIG. 3C, the deflection element 4 is locked on the socket 3*a* by means of the locking element 5. In this condition, the deflection element 4 is stationarily and non-rotatably held on the socket 3*a*. In the exemplary embodiment, a locking element 5 formed as latching element is provided for this purpose. With a latching hook 51 arranged on its base body 50 the same engages over the deflection element 4 such that it is held in its functional position. As will yet be explained below with reference to FIGS. 5A and 5B, the configuration here is such that the cable forces of the flexible traction means Z, which act on the deflection element 4 in its functional position, already hold the deflection element 4 in its functional position. The locking element 5 then substantially has a supporting function, e.g. also during the assembly.

In FIGS. 3A to 3C pivoting of the deflection element 4 from its mounting position, cf. FIG. 3B, into its proper functional position (cf. FIG. 3C) for better clarity is shown without the associated flexible traction means which is to be guided in the cable groove 41 on the deflection element 4. Especially in conjunction with a flexible traction means arranged on the deflection element 4, however, that swivel movement is of particular importance, because it at the same time contributes to tightening of the flexible traction means. This will be discussed below with reference to FIGS. 4A and 4B.

Figure 4B:
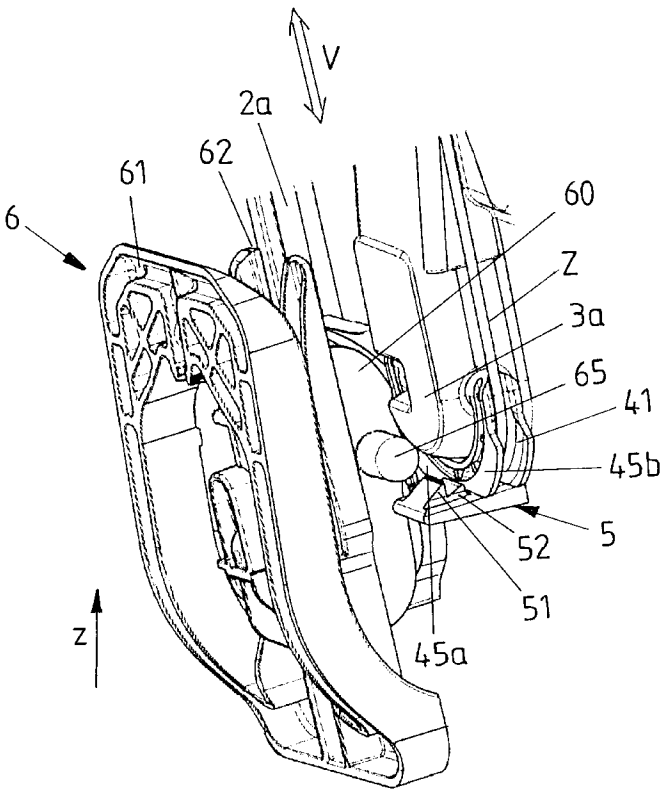
FIG. 4B shows the arrangement of FIG. 4A after transferring the deflection element into its functional position on the socket.
Figure 4A:
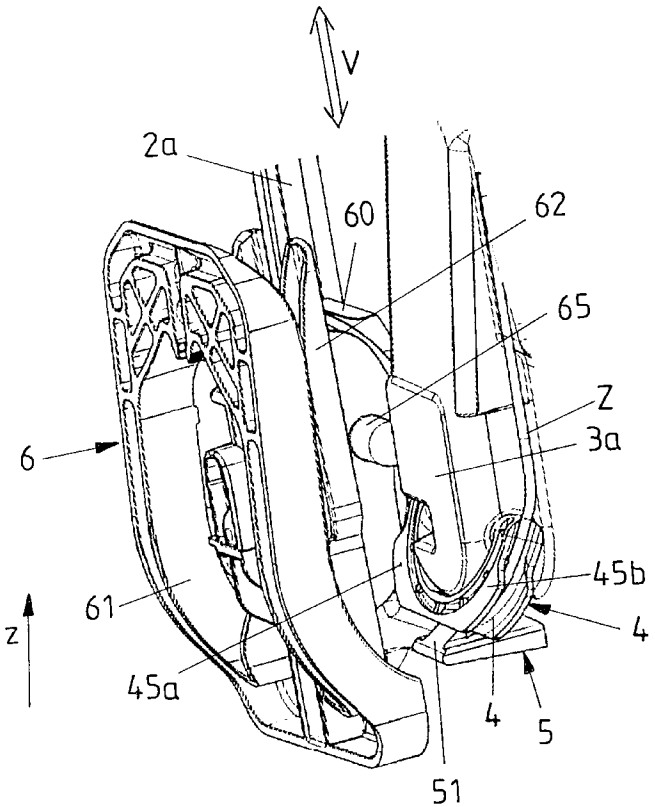
FIG. 4A shows the arrangement of FIGS. 3A to 3C, wherein the deflection element is in a mounting position on the socket and wherein furthermore a driver of the window regulator assembly guided on a guide rail is shown, which for transferring the deflection element from a mounting position into the functional position acts on the latter.

FIG. 4A shows the socket 3*a* and the deflection element 4 as well as the locking element 5 together with an associated guide rail 2*a* of the window regulator assembly and a driver 6 longitudinally shiftably mounted on the guide rail 2*a*. As explained already with reference to FIG. 1, the guide rail defines an adjustment path V for the window pane to be adjusted. Along this adjustment path V a window pane accommodated on the driver 6 is moved when the driver 6 is moved along the guide rail 2*a* by action of the flexible traction means Z. As shown in FIG. 1, the flat window pane moves along an adjustment surface F on which the adjustment path V defining the adjustment direction also is located.

The driver 6 on the one hand assumes the function of coupling a window pane to be adjusted to the guide rail 2*a* in order to impose the adjustment path V defined by the guide rail 2*a* on the window pane, and on the other hand the connection of the window pane with the flexible traction means Z in order to transmit an adjusting force acting on the flexible traction means Z to the window pane to be adjusted.

The driver 6 therefor on the one hand includes a slider 60 which is longitudinally movably mounted on the guide rail 2*a* extending along the adjustment path V. Furthermore, the driver 6 comprises a pane receptacle connected with the slider 60, which has two driver legs 61, 62 between which a window pane to be adjusted can be accommodated and fastened in a known way in the region of its pane lower edge. Furthermore, the driver 6 in a usual way includes a fastening arrangement not shown in FIG. 4A, by means of which the driver 6 can be attached to the flexible traction means Z, so that an adjusting force acting on the flexible traction means Z can be transmitted to the driver 6 in order to shift, namely lift or lower the same on the guide rail 2*a* along the adjustment path V, and thereby entrain the window pane to be adjusted, which is accommodated on the driver 6.

Furthermore, an actuating element 65 is provided on the driver 6, via which the driver can act on at least one of the mounting surfaces 45*a*, 45*b* of the deflection element 4 when the driver—as shown in FIG. 4A—is moved in the direction of its lowermost adjustment position on the guide rail.

In FIG. 4A, the deflection element 4 still is in a mounting position on the socket 3*a*; for example corresponding to the mounting position shown in FIG. 3B. This means that in the condition shown in FIG. 4A the deflection element 4 has not yet been transferred into its proper functional position on the socket 3*a*, which is shown in FIGS. 3C and 4B. This transfer rather should be effected by action of the driver-side actuating element 65 on (at least) one of the actuating surfaces 45*a*, 45*b* on the deflection element 4, when the driver 6 is lowered even further along the guide rail 2*a* from the already lowered position shown in FIG. 4A corresponding to the transition to FIG. 4B. With its actuating element 65 the driver acts on an actuating surface 45*a* of the deflection element 4, namely such that the deflection element 4 is pivoted from the mounting position shown in FIG. 4A into the proper functional position (end position) shown in FIG. 4B, in which the driver is held by the locking element 5.

In the exemplary embodiment according to FIGS. 4A and 4B the locking element 5 is of two-stage form. In a first locking stage, as shown in FIG. 4A, the locking element 5 in its mounting position engages over the deflection element 4 with a second latching hook 52 in order to hold the deflection element 4 in the mounting position, while the driver 6 is lowered along the guide rail 2*a* in order to act on the one actuating surface 45*a* of the deflection element 4 by means of the actuating element 65 and transfer said deflection element into its functional position. In the latter position the deflection element 4, as illustrated in FIG. 4B, then is held by means of a first latching hook 51 of the locking element 5.

In the exemplary embodiment the driver-side actuating element 65 is shown as a simple bolt or pin. Alternatively, the same for example can also be designed as a ramp or inclined surface which is adjusted to the actuating surface(s) 45*a*, 45*b* on the deflection element 4.

In general, the arrangement shown in FIGS. 4A and 4B provides for a transfer of the deflection element 4 from a mounting position into its functional position by pivoting the deflection element 4 with respect to the socket 3*a* by action of the driver 6 guided on the guide rail 2*a*, which moreover serves for connecting a window pane to the window regulator assembly. For this purpose, said driver merely must be moved into a lower position on the corresponding guide rail 2*a* by means of an adjustment drive of the window regulator assembly provided anyway, so that it acts on an actuating surface 45*a*, 45*b* of the deflection element 4 with its actuating element 65.

Figure 5A:
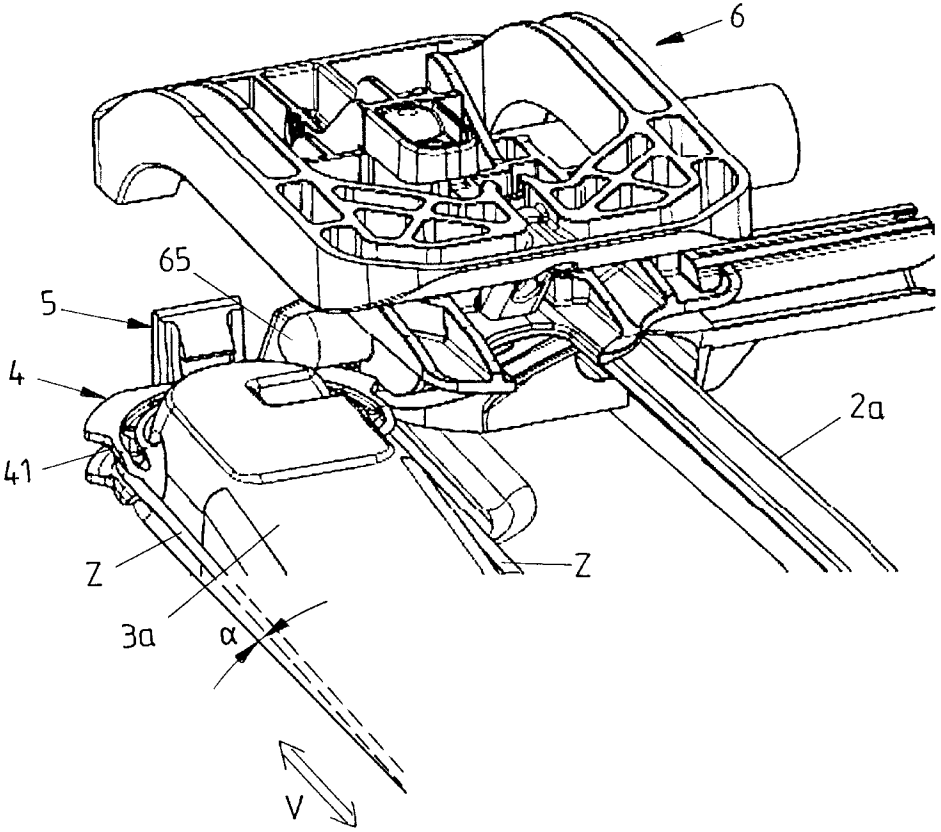
FIG. 5A shows the arrangement of FIG. 4B in a perspective view in which transverse forces acting on the flexible traction means are illustrated.
Figure 5B:
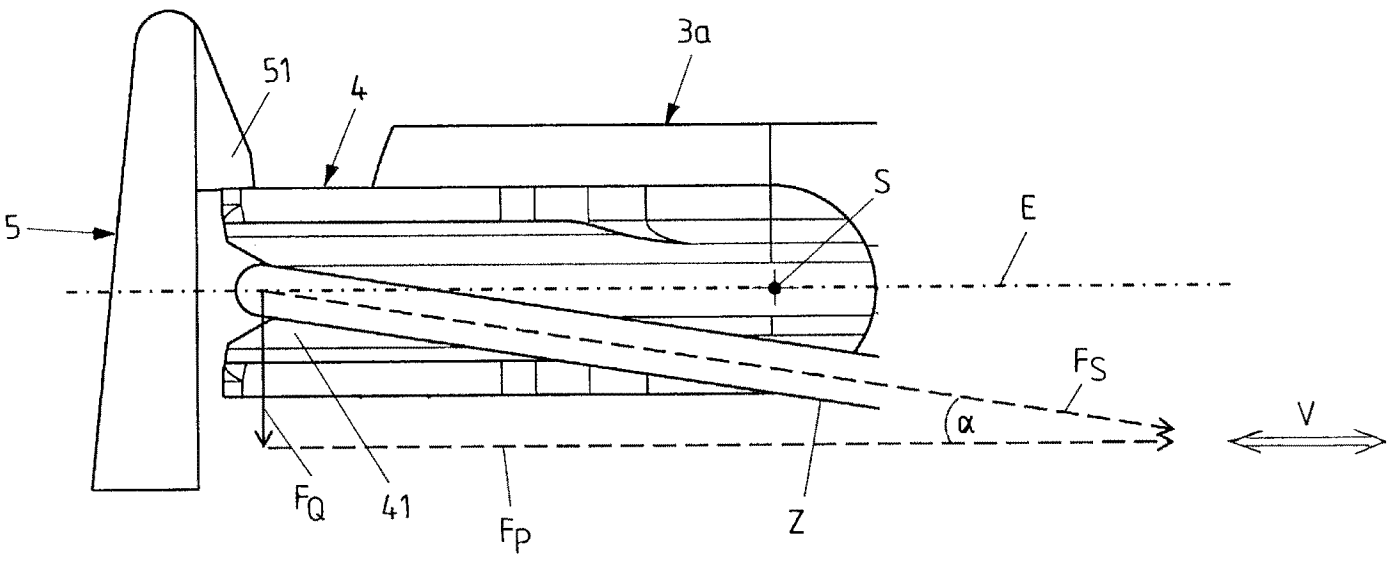
FIG. 5B shows a schematic side view of the arrangement of FIG. 5A.

With reference to FIGS. 5A and 5B details of the guidance of the flexible traction means Z in the region of the deflection element 4 can be seen, from which it can be taken that the flexible traction means Z exerts a force on the deflection element 4 which has the tendency to hold the deflection element 4 in its functional position on the socket 3*a*. The flexible traction means Z therefor is guided on the deflection element 4 or in its cable groove 41 such that in the direct vicinity of the deflection element 4, i.e. in a respective section proceeding from the deflection element, it forms a small inclination angle $\alpha$ with the adjustment path V defined by the guide rail 2*a* or coinciding with its direction of extension. The cable force $F_S$ acting on the flexible traction means Z thereby can be split into a force component $F_P=F_S*\cos\alpha$ acting parallel to the adjustment path V and a transverse force $F_Q=F_S*\sin\alpha$ acting vertically thereto. The last-mentioned force component (transverse force $F_Q$) has the tendency to hold the deflection element 4 in its functional position on the socket 3*a*. The latter becomes possible among other things by the above-described course of the pivot axis S.

In summary, the flexible traction means Z is guided on the deflection element 4 such that at least one portion of the flexible traction means Z proceeding from the deflection element 4 extends with an inclination to the adjustment path V and in particular also to the adjustment surface F defined by the adjustment path V, cf. FIG. 1, and thereby exerts a force $F_Q$ on the deflection element 4, which has the tendency to hold the deflection element 4 in its functional position on the socket 3*a*, 3*b*.

FIG. 5B also again clearly shows the (physical) pivot axis S (defined by the bearing points 32*a*, 32*b* and bearing elements 42, 42*b*), about which the deflection element 4 can be pivoted with respect to the socket 3*a* in order to bring the deflection element 4 from a mounting position into its proper functional position on the socket 3*a*. Pivoting out of this functional position once reached is prevented by the transverse force $F_Q$ exerted by the flexible traction means Z on the deflection element 4 or its cable groove 4 and in addition by the locking element 5.

Furthermore, in FIG. 5B the plane E defined by the course of the cable groove 41 is indicated in broken lines, with respect to which the deflection element 4 is symmetrical.

Figure 6B:
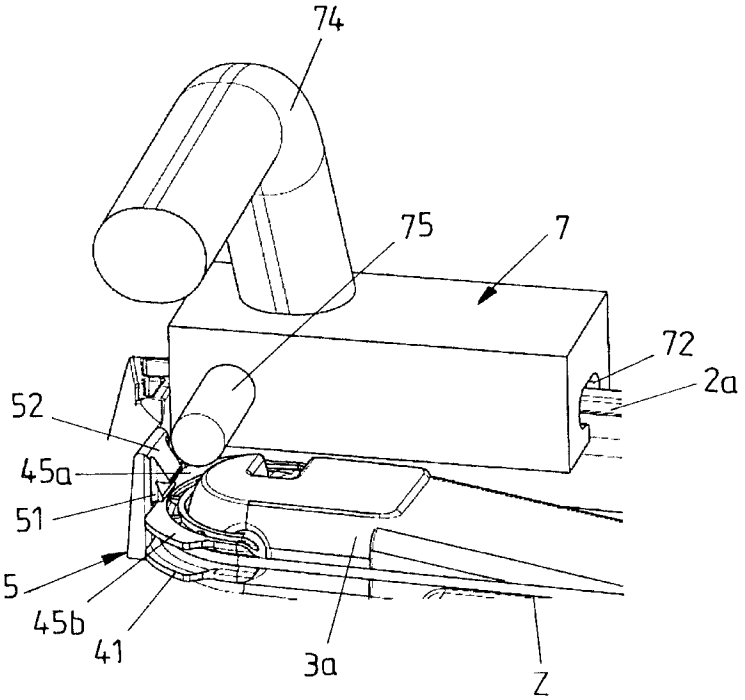
FIG. 6B shows the arrangement of FIG. 6A after transferring the deflection element into its functional position.
Figure 6A:
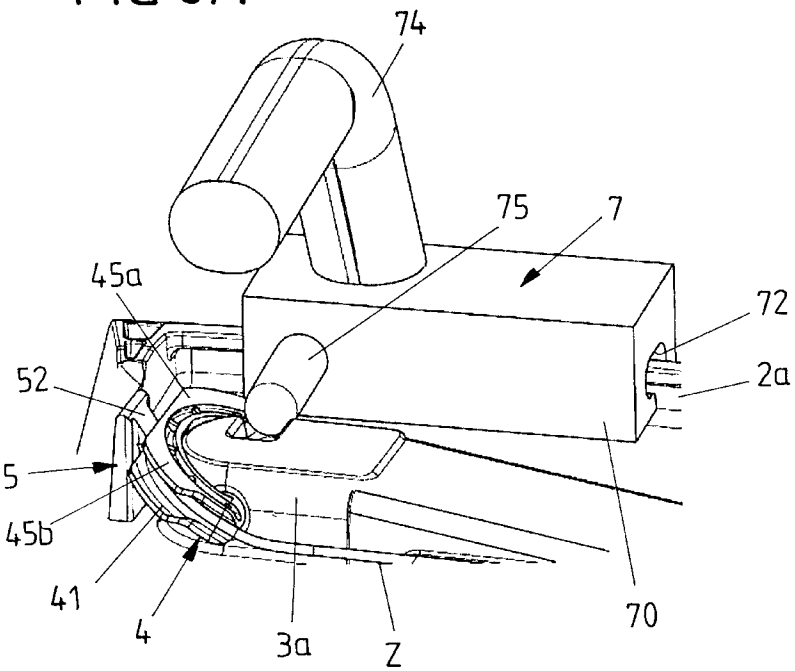
FIG. 6A shows a modification of the arrangement of FIGS. 4A and 4B, wherein a mounting carriage is utilized for transferring the deflection element from a mounting position into the functional position.

FIGS. 6A and 6B show a modification of the exemplary embodiment of FIGS. 4A and 4B with regard to the actuation of the deflection element 4 in order to pivot the same from its mounting position into the proper functional position on the socket 3*a*. The difference to the arrangement of FIGS. 4A and 4B consists in that for actuating the deflection element 4 or more exactly at least one of the actuating surfaces 45*a*, 45*b* of the deflection element 4 a mounting carriage 7 is used instead of the driver 6 belonging to the window regulator assembly, which is arranged on the guide rail 2*a* especially for transferring the deflection element 4 into its functional position on the guide rail 2*a* and which is longitudinally shiftably in engagement with the guide rail 2*a* via an engagement region 72. In the exemplary embodiment, an actuating handle 74 projects from the base body 70 of the mounting carriage 7, by which the mounting carriage 7 can be grasped in order to shift the same along the guide rail 2*a*. Furthermore, an actuating element 75 is provided on the mounting carriage 7, which on shifting of the mounting carriage 7 along the guide rail 2*a* can act on one of the actuating surfaces 45*a*, 45*b* of the deflection element 4.

FIG. 6A shows the arrangement first in a condition in which the deflection element 4 is in a mounting position, in which it is held by a second latching hook 52 of the locking element 5. The mounting carriage 7 is spaced apart from the deflection element 4 such that it does not act on its mounting surface(s) 45*a*, 45*b*.

FIG. 6B shows the arrangement of FIG. 6A after the mounting carriage 7 has been shifted along the guide rail 2*a* such that its actuating element 75 has brought about a swivel movement of the deflection element 4 by acting on an actuating surface 45*a* of that deflection element 4, by which swivel movement the latter has been transferred into its proper functional position on the socket 3*a*, namely by at the same time additionally tightening the flexible traction means Z arranged on the deflection element 4 or more exactly on its cable groove 41. The deflection element is secured in this functional position by a first latching hook 51 on the locking element 5; possibly merely in addition to loading the deflection element 4 into its functional position by means of a transverse force acting on the flexible traction means Z, which is explained with reference to FIGS. 5A and 5B.

Figure 7A:
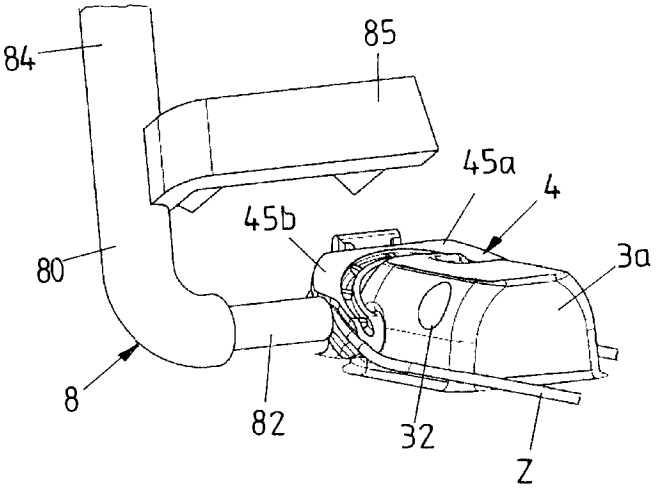
FIG. 7A shows a further modification of the arrangement of FIGS. 4A and 4B, wherein a mounting lever mounted on the socket is utilized for transferring the deflection element from a mounting position into the functional position.
Figure 7B:
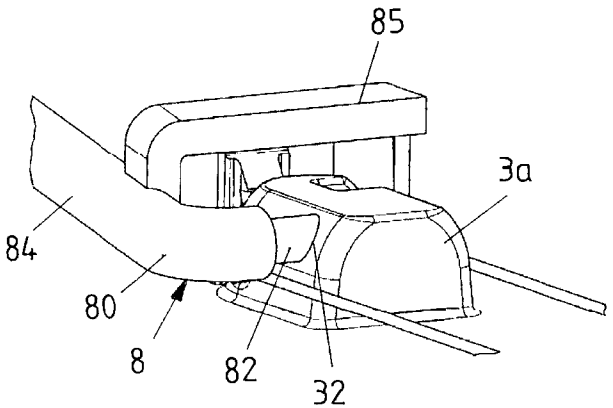
FIG. 7B shows the arrangement of FIG. 7A after transferring the deflection element into the functional position.
Figure 7C:
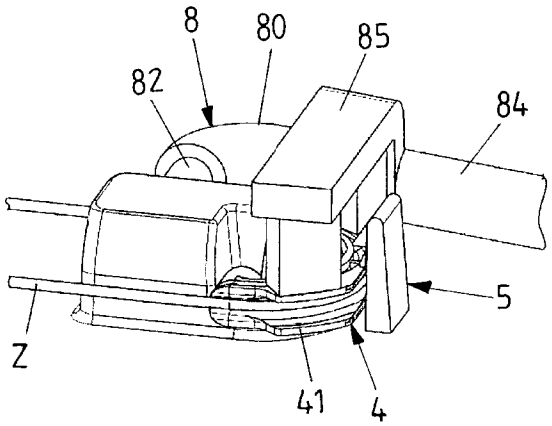
FIG. 7C shows a further view of the arrangement according to FIG. 7B.

FIGS. 7A to 7C show a further modification of the arrangement of FIGS. 4A and 4B, wherein for the actuation of the deflection element 4 in order to transfer the same from a mounting position into the proper functional position a lever assembly 8 is used. According to FIG. 7A, the same comprises an actuating lever 80 with a lever portion 84 serving as handle and with a bearing portion 82 for pivotally supporting the actuating lever 80 on a bearing point 32 (bearing opening) of the socket 3*a* provided for this purpose, cf. FIG. 7B. Furthermore, an actuating element 85 is arranged on the lever 80, which during pivoting of the lever 80 acts on at least one actuating surface 45*a*, 45*b* of the deflection element 4 in order to transfer the same from the mounting position shown in FIG. 7A into the proper functional position shown in FIGS. 7B and 7C.

The lever assembly 8—just like the mounting carriage 7 of FIGS. 6A and 6B—is arranged on the window regulator assembly merely for assembly purposes, namely on the guide rail 2*a* in the case of the mounting carriage 7 or on a bearing point of the socket 3*a* in the case of the lever 80 of the lever assembly 8. After properly transferring the deflection element 4 into its functional position on the socket 3*a*, the mounting carriage 7 or the lever assembly 8 can again be removed from the window regulator assembly and be used for mounting activities on a further window regulator assembly.

Pivoting of the deflection element 4 from a mounting position into its functional position each contributes to tightening of the flexible traction means Z guided on the deflection element 4. The final traction means tension possibly can be brought about when threading the flexible traction means onto a cable pulley which is rotatably mounted on a bearing point 25, cf. FIG. 1, in particular by using a self-threading cable pulley.

The invention claimed is:

1. A window regulator assembly for a motor vehicle, the window regulator comprising:

a carrier;

a guiding device on the carrier;

a flexible traction device on the guiding device, wherein at least one driver is fixed on the flexible traction device such that a window pane to be adjusted is connected with the flexible traction device by the at least one driver, so that the at least one driver together with the window pane attached thereto is adjustable when an adjusting force is introduced into the flexible traction device along a longitudinally extended adjustment path defining an adjustment surface for the window pane; and a deflection element pivotally mounted on a socket, wherein the deflection element is configured to be borne by the socket and the flexible traction device is configured to be deflected by the deflection element, wherein the adjusting force is configured to be transmitted to the window pane via the flexible traction device, wherein the deflection element is configured to be transferred by a swivel movement from a mounting position into a functional position on the socket by tightening the flexible traction device, wherein the deflection element is configured to be held on the socket in the functional position, and wherein the deflection element is pivotally mounted on the socket about an axis, wherein the axis extends parallel to the adjustment surface defined by the adjustment path and transversely to a direction of longitudinal extension of the adjustment path.

2. The window regulator assembly according to claim 1, wherein the socket is integrally molded to the carrier.

3. The window regulator assembly according to claim 1, wherein locking elements are on the socket and are associated with the deflection element, wherein the deflection element is configured to be locked at least in the functional position by the locking elements.

4. The window regulator assembly according to claim 3, wherein the locking elements comprise at least one latching element for latching the deflection element in the functional position of the deflection element on the socket.

5. The window regulator assembly according to claim 3, wherein the locking elements are of a two-stage design such that the deflection element is configured to be held on the one hand in the mounting position and on the other hand in the functional position on the socket.

6. The window regulator assembly according to claim 1, wherein the deflection element is designed as a ring segment which extends over an angle between 150° and 210°.

7. The window regulator assembly according to claim 1, wherein the deflection element includes a cable groove in which the flexible traction device is guided, and wherein the deflection element is designed symmetrically with respect to a plane defined by a course of the cable groove.

8. The window regulator assembly according to claim 7, wherein the deflection element includes at least one actuating surface, wherein an actuating element is configured to act on the at least one actuating surface such that the deflection element is transferred from the mounting position into the functional position and wherein on the deflection element actuating surfaces are arranged on both sides of a plane defined by the cable groove.

9. The window regulator assembly according to claim 1, wherein the deflection element includes at least one actuating surface, wherein an actuating element is configured to act on the at least one actuating surface such that the deflection element is transferred from the mounting position into the functional position.

10. The window regulator assembly according to claim 9, wherein the actuating element is provided on the driver, the actuating element being configured to act on at least one actuating surface of the deflection element during a displacement of the driver along the guiding device by an adjusting force acting on the flexible traction device such that the deflection element is transferred from the mounting position into the functional position on the socket.

11. The window regulator assembly according to claim 1, wherein bearing points for pivotally bearing the deflection element and a mounting surface for guiding the deflection element during pivoting are arranged on the socket.

12. The window regulator assembly according to claim 11, wherein one of the bearing points permits pivoting of the deflection element about the pivot axis only when the deflection element also is properly arranged on another one of the bearing points.

13. The window regulator assembly according to claim 1, wherein the flexible tractions device is configured to be guided on the deflection element such that at least one portion of the flexible traction device proceeding from the deflection element extends with an inclination to the adjustment surface defined by the adjustment path and thereby exerts a transverse force on the deflection element, wherein the transverse force biases the deflection element in the functional position on the socket.

14. The window regulator assembly according to claim 1, wherein based on a condition of the window regulator assembly installed in a motor vehicle, the deflection element is arranged at a lower end of the guiding device and a rotatable cable pulley for deflecting the flexible traction device is mounted at the upper end of the guiding device.

15. The window regulator assembly according to claim 1, wherein a mounting carriage is releasably arranged for assembly purposes on the guiding device, wherein the mounting carriage includes an actuating element and is configured to be moved along the guiding device such that the mounting carriage acts on a mounting surface of the deflection element in order to transfer the deflection element from a mounting position into the functional position.

16. The window regulator assembly according to claim 1, wherein a lever is releasably mounted on the socket for assembly purposes, wherein the lever includes an actuating element and is pivotable on the socket such that the lever is configured to act on a mounting surface of the deflection element in order to transfer the deflection element from a mounting position into the functional position.

* * * * *